US008898937B2

(12) United States Patent
Campomanes

(10) Patent No.: US 8,898,937 B2
(45) Date of Patent: Dec. 2, 2014

(54) SCREW-ADJUSTABLE CONNECTOR APPARATUS FOR TELESCOPED WEAR AND SUPPORT MEMBERS

(71) Applicant: Hensley Industries, Inc., Dallas, TX (US)

(72) Inventor: Patrick Campomanes, Washington, IL (US)

(73) Assignee: Hensley Industries, Inc., Dallas, TX (US)

( * ) Notice: Subject to any disclaimer, the term of this patent is extended or adjusted under 35 U.S.C. 154(b) by 114 days.

(21) Appl. No.: 13/761,287

(22) Filed: Feb. 7, 2013

(65) Prior Publication Data

US 2013/0247429 A1 Sep. 26, 2013

Related U.S. Application Data

(60) Provisional application No. 61/613,748, filed on Mar. 21, 2012.

(51) Int. Cl.
*E02F 9/28* (2006.01)

(52) U.S. Cl.
CPC ..... *E02F 9/2833* (2013.01); *E02F 9/2825* (2013.01)
USPC ..... 37/456

(58) Field of Classification Search
CPC ..... E02F 9/2825; E02F 9/2833; E02F 9/2841; E02F 9/2891
USPC ..... 37/446, 450–460; 403/21, 22, 320, 255, 403/374, 375
See application file for complete search history.

(56) References Cited

U.S. PATENT DOCUMENTS

| | | | | |
|---|---|---|---|---|
| 4,433,496 | A | | 2/1984 | Jones et al. |
| 5,452,529 | A | | 9/1995 | Neuenfeldt et al. |
| 5,638,621 | A | * | 6/1997 | Keech et al. ..... 37/446 |
| 5,784,813 | A | * | 7/1998 | Balassa et al. ..... 37/455 |
| 5,964,547 | A | | 10/1999 | Brinkley |
| 6,301,810 | B1 | | 10/2001 | Fidler |
| 6,986,216 | B2 | | 1/2006 | Emrich et al. |
| 7,171,771 | B2 | | 2/2007 | Briscoe |
| 7,174,661 | B2 | | 2/2007 | Briscoe |

(Continued)

FOREIGN PATENT DOCUMENTS

WO WO 00/20696 4/2000

OTHER PUBLICATIONS

International Search Report and Written Opinion issued for PCT/US2013/030342 dated May 21, 2013, 10 pgs.

*Primary Examiner* — Robert Pezzuto
(74) *Attorney, Agent, or Firm* — Haynes and Boone, LLP

(57) ABSTRACT

An earth engaging wear member is rearwardly telescoped onto a support member and is releasably retained thereon by specially designed connector apparatus extending through aligned connector openings in the wear and support members. The connector apparatus includes a spool member rearwardly bearing against the wear member, a shim member forwardly spaced apart from the spool member and having a sloping rear surface, and a wedge screw member interposed between the spool and shim members. The wedge screw member has a non-tapered body threadingly engaging the spool member side portion, and a non-threaded, radially sloped surface area rampingly engaging the sloped shim surface area. Threaded advancement of the wedge screw member rearwardly moves the wear member relative to the support member to tighten an operationally-created loosened interfit therebetween.

20 Claims, 3 Drawing Sheets

(56) References Cited

U.S. PATENT DOCUMENTS

| | | | | |
|---|---|---|---|---|
| 7,299,570 | B2 | 11/2007 | Emrich et al. | |
| 7,997,017 | B2 | 8/2011 | McClanahan et al. | |
| 8,434,248 | B2 * | 5/2013 | Woerman et al. | 37/456 |
| 8,720,088 | B2 * | 5/2014 | Knight | 37/456 |
| 2011/0072693 | A1 | 3/2011 | Knight | |
| 2011/0131843 | A1 | 6/2011 | Carpenter | |
| 2012/0051836 | A1 | 3/2012 | Jakubisin | |

* cited by examiner

SCREW-ADJUSTABLE CONNECTOR APPARATUS FOR TELESCOPED WEAR AND SUPPORT MEMBERS

CROSS-REFERENCE TO RELATED APPLICATION

The present application claims the benefit of the filing date of provisional U.S. patent application No. 61/613,748 filed Mar. 21, 2012. The entire disclosure of the provisional application is hereby incorporated herein by this reference.

BACKGROUND OF THE INVENTION

The present invention generally relates to ground-engaging apparatus such as that used in excavating and mining operations and, in a representatively illustrated embodiment thereof more particularly provides specially designed connector apparatus for releasably retaining a ground engaging wear member, such as an adapter, on a support member such an excavating bucket lip.

A ground engaging wear member is typically telescoped rearwardly onto an associated support member and releasably retained thereon using a connector structure extending through aligned connector openings formed through overlapping portions of the wear and support members. A commonly utilized form of such connector structure comprises separate wedge and spool members which must be placed in the aligned connector openings. Two primary disadvantages are commonly associated with many of these spool and wedge-type connector structures. First, in such wedge and spool connector structures, after the spool is inserted into the connector openings the wedge must be pounded into place to forcibly engage the spool and thereby lock the spool and wedge in place within the connector openings and prevent the wear member from being forwardly dislodged from the support member. Second, while the initially installed wedge and spool hold the wear member tightly on the support member, the high operational forces typically borne by the wear member/support member assembly may undesirably loosen this interfit with no convenient method of retightening it.

As can be seen from the foregoing, a need exists for improved wear member/support member connector structure which alleviates the above-mentioned disadvantages presented by conventional wedge and spool structures of the types generally described above. It is accordingly a primary goal of the present invention to provide such connector structure.

DETAILED DESCRIPTION

Figure 1:
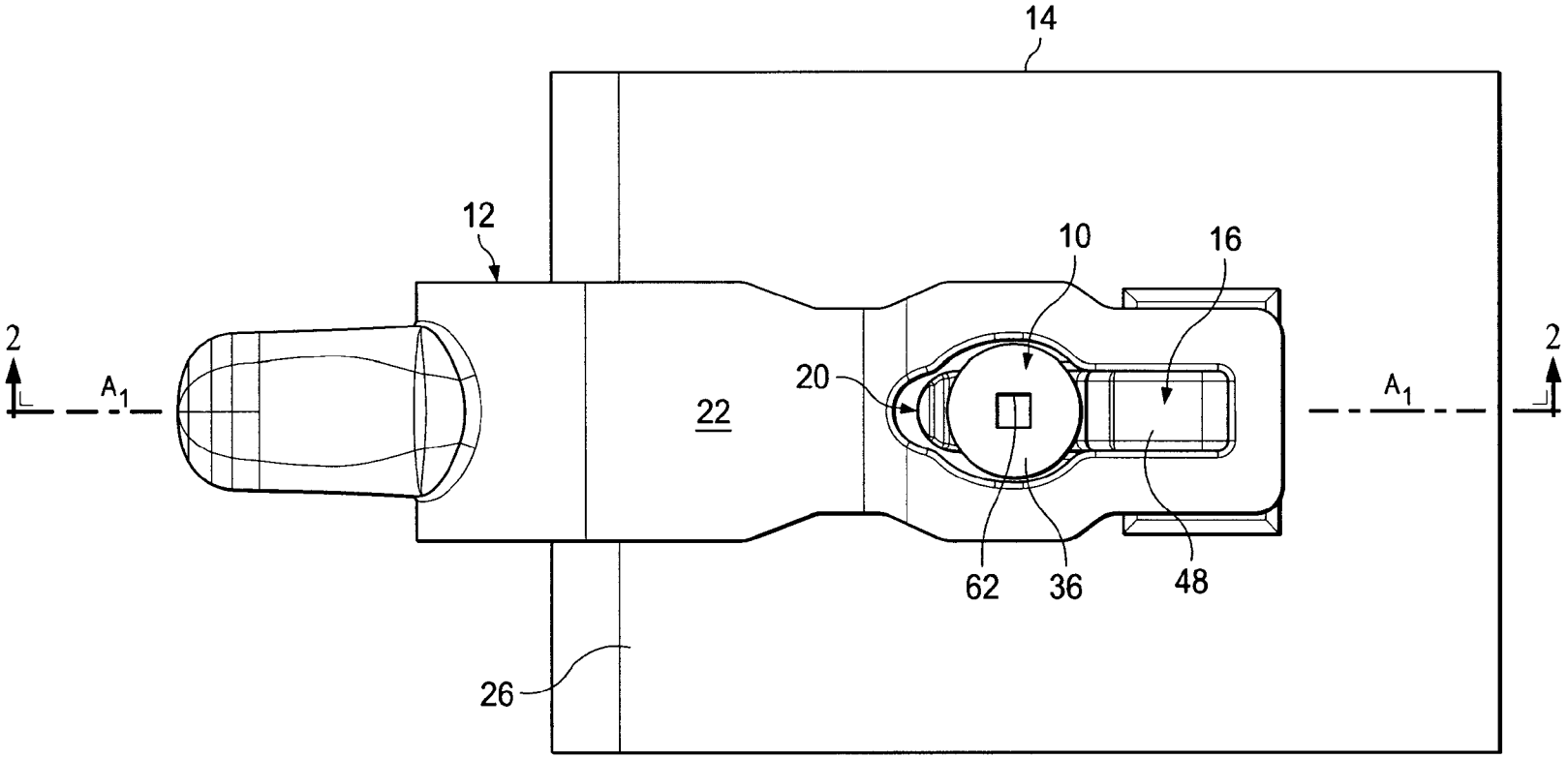
FIG. 1 is a top plan view of a front edge portion of an excavating bucket lip to which a wear member, representatively an adapter, is removably secured in a telescoping relationship therewith by specially designed screw-adjustable connector apparatus embodying principles of the present invention.
Figure 2:
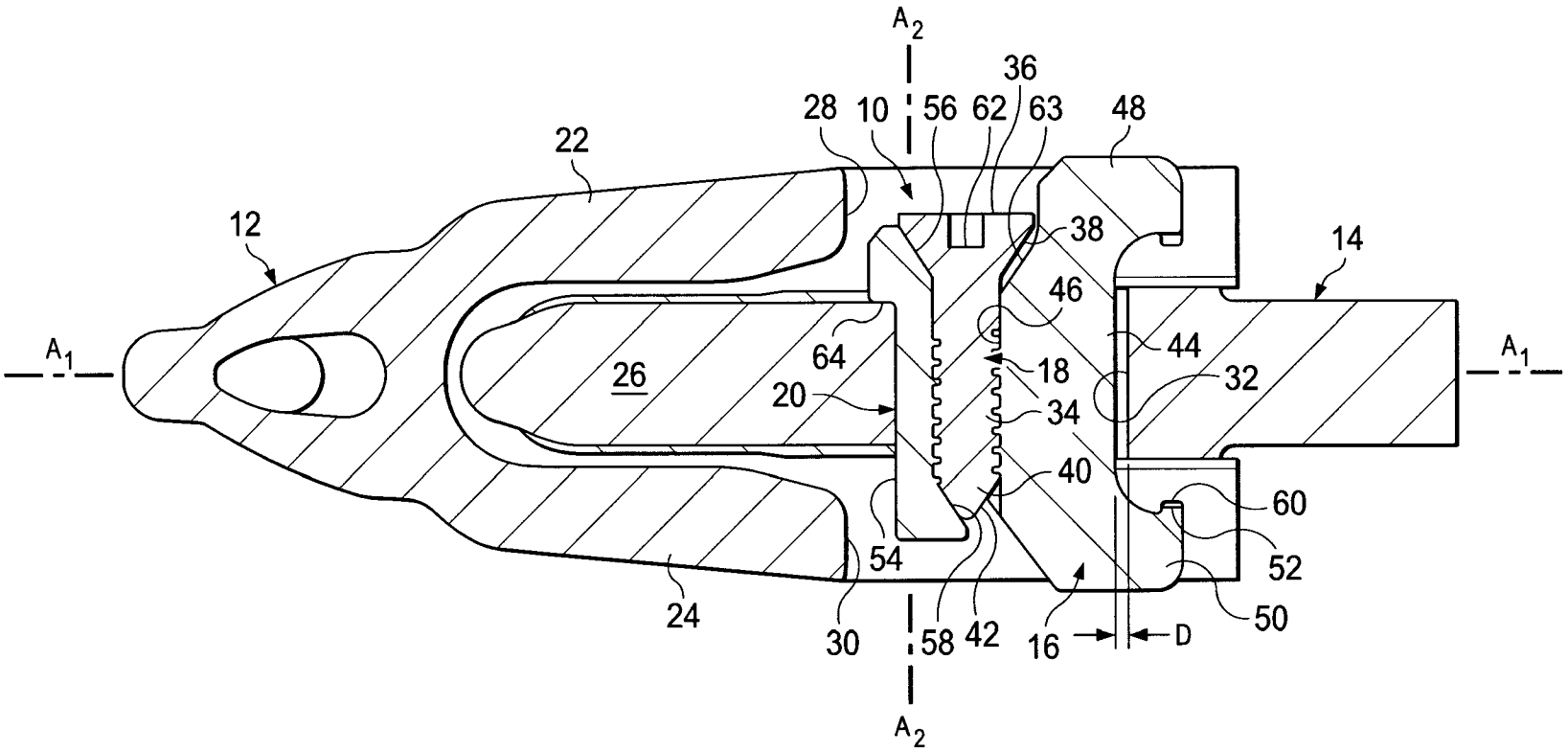
FIG. 2 is a cross-sectional view through the bucket lip portion taken generally along line 2-2 of FIG. 1.
Figure 4:
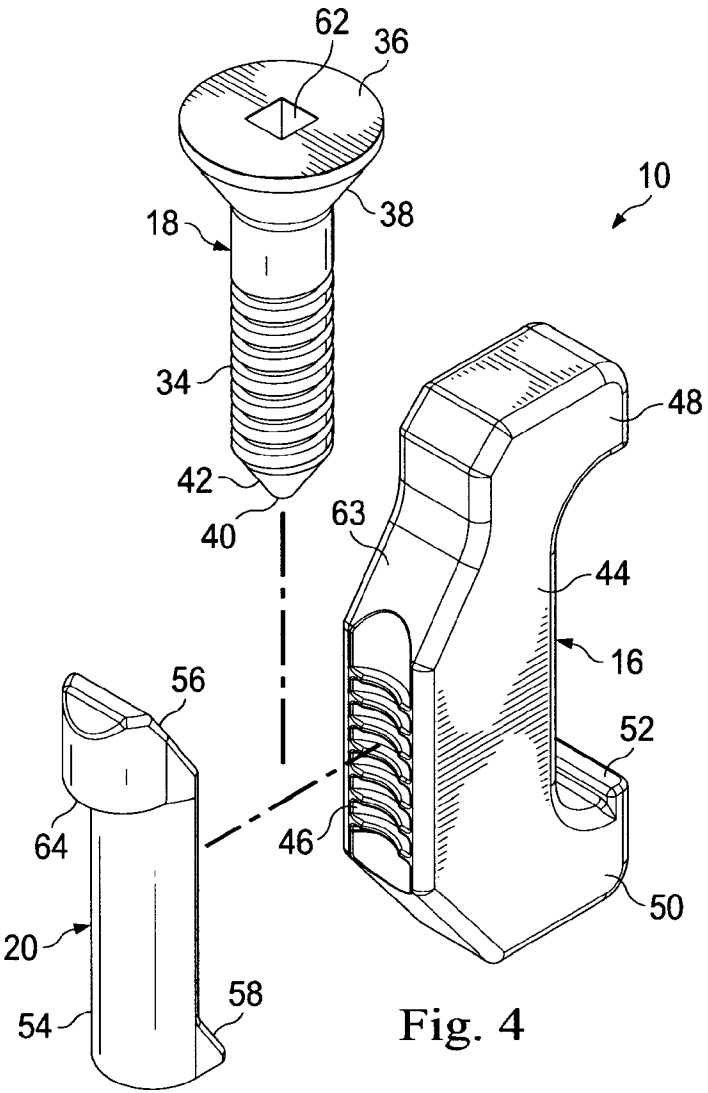
FIG. 4 is an exploded perspective view of the connector apparatus shown in FIG. 3.
Figure 3:
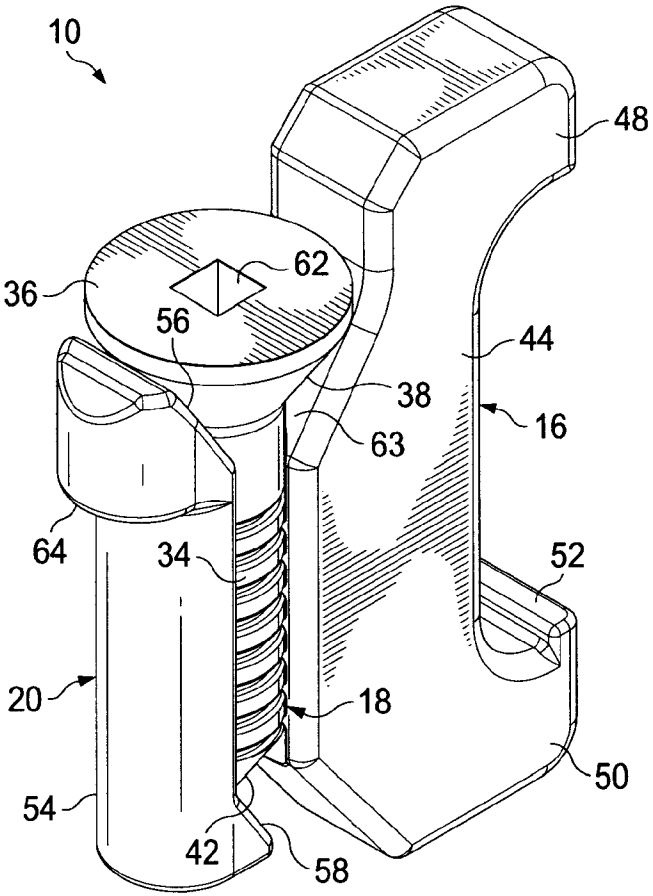
FIG. 3 is a perspective view of the connector apparatus removed from the telescoped wear member and bucket lip.

As illustrated in the accompanying FIGS. 1-4, this invention provides specially designed connector apparatus 10 used to releasably hold a wear member 12 (representatively an adapter) on a support structure 14 (representatively an excavating bucket lip) in a telescoped relationship therewith as depicted in FIGS. 1 and 2. Connector apparatus 10 includes a spool 16, a wedge in the form of a non-tapered screw 18, and a vertically elongated drive shim member 20.

The installed adapter 12 longitudinally extends along a horizontal axis $A_1$ and has top and bottom legs 22, 24 that respectively extend rearwardly along top and bottom sides of a front edge portion 26 of the bucket lip 14. Legs 22, 24 respectively have aligned connector openings 28, 30 which are generally aligned along a vertical axis $A_2$ with a connector opening 32 extending through the front bucket lip edge portion 26. Connector apparatus 10 is installed in the aligned connector openings 28, 30, 32 as cross-sectionally illustrated in FIG. 2 and functions to releasably hold the installed adapter 12 on the bucket lip 14 to form the wear member/support member assembly shown in FIGS. 1 and 2, with the screw 18 being rotatable, as later described, to rearwardly tighten the adapter 12 on the lip 14 to compensate for operational wear between these two components.

Screw 18 has a non-tapered, threaded body portion 34, a non-threaded head 36 with a downwardly and inwardly tapered side surface 38, and a non-threaded point 40 with a downwardly and inwardly tapered side surface 42. Spool 16 has a vertical body portion 44 with a threaded front side 46 mateable with the threads on the non-tapered screw body portion 34, and rearwardly extending top and bottom end projections 48 and 50. A locking projection 52 extends upwardly from the bottom end portion 50. The drive shim member 20 has a vertically elongated body portion 54 with rearwardly and downwardly sloping drive surfaces 56, 58 respectively disposed at its upper ends.

With the connector apparatus 10 operatively installed (see FIG. 2), the screw 18 is disposed between the spool 16 and the drive shim member 20, with the screw head tapered side surface 38 complementarily and slidingly engaging the tapered shim drive surface 56 and the screw point tapered side surface 42 complementarily and slidingly engaging the sloping tapered shim drive surface 58. The screw body 34 threadingly engages the threaded front side 46 of the spool 16 (but does not threadingly engage the shim member 20). As best illustrated in FIG. 2, the end projection 52 on the spool 16 is lockingly received in a corresponding notch 60 in the lower adapter leg 24.

Using a non-circular drive opening 62 in the top surface of the screw head 36 (which is representatively square, but could alternatively be of another non-circular configuration such as hexagonal), the installed screw 18 may be threadingly advanced (downwardly) to thereby cause the ramped screw/shim member bearing surface pairs 38, 56 and 42, 58 to rearwardly drive the spool 16 relative to the shim member 20, thereby rearwardly drive the adapter 12 relative to the bucket lip 14 and tighten the adapter 12 thereon. The total downward advancement of the screw 18 is limited by a forwardly and downwardly sloped abutment surface 63 disposed on the front side of the spool 12 adjacent its top end portion 48 and extending parallel to the tapered side surface 38 of the screw head 36. As can be seen, surface 63 acts as a downward stop surface for the screw head 36.

With the adapter 12 and front lip edge portion 26 in their FIG. 2 telescoped orientation, the connector apparatus 10 is installed by first placing the spool 16 and the drive shim member 20 in their orientations within the adapter and lip openings 28, 30 and 32 shown in FIG. 2 with the spool locking projection 52 received in the interior bottom leg notch 60 of the spool, and a bottom surface 64 of the upper end of the drive shim member 20 resting on the top side surface of the lip 14. The screw or wedge 18 is then inserted between the spool 16 and shim 20 and threadingly advanced downwardly to rearwardly drive the adapter 12 to the initially tightened position relative to the lip 14 shown in FIG. 2.

At this initial rearward location of the spool 16 its vertical body portion 44 is located a small distance D forwardly of the rear side of the connector opening 32 (see FIG. 2). When operational wear loosens the forward-to-rear "fit" between the adapter 12 and the lip 14 the screw 18 may be further tightened to move the adapter 12 further rearwardly along the lip 14. As can be seen, such rearward tightening may be successively carried out until the adapter 12 has been rearwardly moved the distance D at which point the spool body 44 comes into abutment with the rear side of the connector opening 32.

As can be seen, the representatively illustrated embodiment of the connector apparatus 10 is of a simple, rugged construction and permits a reliable and tightenable telescoped connection between the adapter 12 and the bucket lip 14. The connector apparatus 10 may be safely installed and removed without the need to pound the wedge portion 18 in or out of the adapter/lip assembly, and no portion of the installed connector apparatus 10 appreciably projects outwardly of the adapter 12, thereby shielding it from operational abrasion wear. Further, the screw 18 is easily accessible to permit adapter positional adjustment when necessary.

While the connector apparatus 10 has illustratively been shown as being used to releasably connect an adapter to a bucket lip, it will be readily apparent to those of ordinary skill in the earth engagement art that it could be advantageously utilized to releasably retain other types of wear members (such as replaceable tooth points) in telescoped relationships with other types of support structures (such as adapters).

The foregoing detailed description is to be clearly understood as being given by way of illustration and example only, the spirit and scope of the present invention being limited solely by the appended claims.

What is claimed is:

1. An earth engaging assembly comprising:

a support member;

a wear member telescoped with said support member rearwardly along a first axis;

said support member and said wear member having communicating connector openings generally aligned along a second axis transverse to said first axis; and connector apparatus disposed in said connector openings and releasably retaining said wear member on said support member, said connector apparatus comprising:

a spool member having a central body portion longitudinally extending parallel to said second axis and having opposite end portions rearwardly bearing against said wear member, a shim member forwardly spaced apart from said spool member and having a central body portion longitudinally extending parallel to said second axis and forwardly bearing against said support member, and first and second ends with rearwardly facing sloped surfaces thereon, and a wedge screw member positioned between said spool member and said shim member and having (1) a threaded, non-tapered body portion longitudinally extending parallel to said second axis and threadingly engaging a front side portion of said central body portion of said spool member, (2) a non-threaded head portion with a tapered side surface rampingly engaging said sloped surface of said first end of said shim member, and (3) a non-threaded point portion with a tapered side surface rampingly engaging said sloped surface of said second end of said shim member, said wedge screw member being threadingly advanceable relative to said spool member to rearwardly move said spool member relative to said shim member and thereby rearwardly move said wear member relative to said support member.

2. The earth engaging assembly of claim 1 wherein:

said wear member is outwardly telescoped onto said support member.

3. The earth engaging assembly of claim 2 wherein:

said connector apparatus is essentially entirely recessed within the balance of said earth engaging assembly.

4. The earth engaging assembly of claim 1 wherein:

said wear member is an adapter, and said support member is a bucket lip.

5. The earth engaging assembly of claim 1 wherein:

said opposite end portions of said central body portion of said spool member are transverse to said central body portion of said spool member and project rearwardly therefrom.

6. The earth engaging assembly of claim 5 wherein:

said wear member has an interior notch, and one of said opposite end portions of said central body portion of said spool member has a locking projection received in said interior notch.

7. The earth engaging assembly of claim 1 wherein:

said spool member has a forwardly facing sloped surface defining a stop surface complementarily engageable by said tapered side surface of said non-threaded head portion of said wedge screw member in a manner precluding further axial advancement of said wedge screw member relative to said spool member.

8. An earth engaging assembly comprising:

a support member;

a wear member rearwardly telescoped onto said support member, said support member and said wear member having generally aligned connector openings extending therethrough; and connector apparatus extending through said connector openings and releasably retaining said wear member on said support member, said connector apparatus comprising:

a spool member rearwardly bearing against said wear member, and a forwardly facing side portion, a shim member forwardly spaced apart from said spool member and having a rearwardly facing sloped surface area; and a wedge screw member interposed between said spool member and said shim member, said wedge screw member having an elongated, non-tapered body portion threadingly engaging said side portion of said spool member, and a non-threaded, radially sloped surface area rampingly engaging said rearwardly facing sloped surface area of said shim member in a manner such that threaded advancement of said wedge screw member relative to said spool member rearwardly moves said wear member relative to said support member.

9. The earth engaging assembly of claim 8 wherein:

said connector apparatus is essentially entirely recessed within the balance of said earth engaging assembly.

10. The earth engaging assembly of claim 8 wherein:
said wear member is an adapter, and
said support member is a bucket lip.

11. The earth engaging assembly of claim 8 wherein:
said spool member has rearwardly projecting opposite end portions bearing against said wear member.

12. The earth engaging assembly of claim 11 wherein:
said wear member has an interior notch, and
one of said opposite end portions of said spool member has a locking projection received in said interior notch.

13. The earth engaging assembly of claim 8 wherein:
said wedge screw member has a radially enlarged head portion, and
said spool member has a stop surface engageable by said head portion in a manner precluding further axial advancement of said wedge screw relative to said spool member.

14. The earth engaging assembly of claim 8 wherein:
said wedge screw member has non-threaded head and point portions having side surface areas defining said radially sloped surface area of said wedge screw member.

15. For use in releasably retaining a ground engaging wear member on a support member onto which the wear member is rearwardly telescoped, the telescoped wear and support members having generally aligned connector openings extending therethrough, connector apparatus being insertable into the connector openings and comprising:
a spool member positionable to rearwardly bear against the wear member;
a shim member having a sloping surface area and positionable in a forwardly spaced relationship with said spool member to forwardly bear against the support member with said sloping surface area facing said spool member and
a wedge screw member interposable between said spool and shim members and having an elongated, non-tapered threaded body portion threadingly engageable with said spool member, and non-threaded, radially sloped surface area rampingly engageable with said sloping surface area of said shim member in a manner such that threaded advancement of said wedge screw member relative to said spool member rearwardly moves the wear member relative to the support member to thereby adjustably tighten the wear member on the support member.

16. The connector apparatus of claim 15 wherein:
said connector apparatus is sized and configured so as to be essentially entirely recessable within the telescoped wear and support members.

17. The connector apparatus of claim 15 wherein:
said spool member has an elongated central body portion from which transverse opposite end portions rearwardly project.

18. The connector apparatus of claim 17 wherein:
one of said opposite end portions of said spool member has a locking projection thereon.

19. The connector apparatus of claim 15 wherein:
said wedge screw member has a radially enlarged head portion, and
said spool member has a stop member positioned and configured to be contacted by said head portion in a manner precluding further axial advancement of said wedge screw member relative to said spool member.

20. The connector apparatus of claim 15 wherein:
said wedge screw member has non-threaded head and point portions having side surface areas defining said radially sloped surface area of said wedge screw member.

* * * * *